US011885087B2

(12) United States Patent
Svanebjerg et al.

(10) Patent No.: US 11,885,087 B2
(45) Date of Patent: Jan. 30, 2024

(54) SYSTEM, UNIT AND METHOD FOR RECOVERING DEICING LIQUIDS FROM AIR-PORT APRON SURFACES

(71) Applicant: VESTERGAARD COMPANY A/S, Roskilde (DK)

(72) Inventors: Elo Svanebjerg, Tappernøje (DK); Stefan Vestergaard, Tappernøje (DK)

(73) Assignee: VESTERGAARD COMPANY A/S, Roskilde (DK)

( * ) Notice: Subject to any disclaimer, the term of this patent is extended or adjusted under 35 U.S.C. 154(b) by 1012 days.

(21) Appl. No.: 16/522,377

(22) Filed: Jul. 25, 2019

(65) Prior Publication Data

US 2020/0048851 A1 Feb. 13, 2020

Related U.S. Application Data

(63) Continuation of application No. PCT/IB2017/057888, filed on Dec. 13, 2017.

(30) Foreign Application Priority Data

Jan. 31, 2017 (WO) ..... PCT/IB2017/050512

(51) Int. Cl.
*E01H 5/09* (2006.01)
*E01H 5/10* (2006.01)

(52) U.S. Cl.
CPC ..... *E01H 5/092* (2013.01); *E01H 5/104* (2013.01)

(58) Field of Classification Search
CPC ..... E01H 5/108; E01H 5/106; E01H 5/104; E01H 8/10; E01H 8/105; E01H 5/092
See application file for complete search history.

(56) References Cited

U.S. PATENT DOCUMENTS 2,977,955 A * 4/1961 Altenburg ..... E01H 5/104 37/227
3,066,428 A * 12/1962 Raiti ..... E01H 5/104 126/343.5 R (Continued)

FOREIGN PATENT DOCUMENTS

FR 434 719 A 2/1912
WO 95/14823 A1 6/1995

(Continued)

OTHER PUBLICATIONS

International Search Report and Written Opinion from International Patent Application No. PCT/IB2017/057888, dated Apr. 4, 2018.

*Primary Examiner* — Jamie L McGowan
(74) *Attorney, Agent, or Firm* — Merchant & Gould P.C.

(57) ABSTRACT

A deicing and/or anti-icing liquid recovery system for recovering deicing and/or anti-icing liquids from airport apron/deicing platform surfaces, the system includes: a deicing-liquid recovery unit; a pump; and a collection tank, where the deicing/anti-icing liquid recovery unit includes a rotatable brush; a baffle; and a sorting tray fluidly connectable to said collection tank via pump, where the rotatable cylindrical brush is arranged to sweep a apron/deicing platform surface such that materials on the apron/deicing platform surface is forced over the baffle and into the sorting tray, wherein said filter is configured to separate liquids and solid phase materials from said swept-up material, and where liquids collected in the sorting tray can be pumped to the collection tank via said pump.

11 Claims, 9 Drawing Sheets

(56) References Cited

U.S. PATENT DOCUMENTS

| | | | | |
|---|---|---|---|---|
| 4,369,540 | A * | 1/1983 | Burgoon | A47L 11/4041 15/49.1 |
| 5,460,657 | A * | 10/1995 | Ally | E01H 1/001 15/345 |
| 5,561,921 | A * | 10/1996 | Vanderlinden | E01H 5/12 37/227 |
| 5,630,286 | A * | 5/1997 | Vanderlinden | E01H 5/104 15/322 |
| 5,797,203 | A * | 8/1998 | Vanderlinden | E01H 5/104 37/227 |
| 6,842,940 | B2 * | 1/2005 | Christopher | A47L 11/302 15/340.4 |
| 2010/0147331 | A1 | 6/2010 | Coppola et al. | |
| 2011/0214251 | A1 | 9/2011 | Boulanger et al. | |
| 2016/0053452 | A1 * | 2/2016 | Treglown | E01H 5/104 37/228 |

FOREIGN PATENT DOCUMENTS

| | | | |
|---|---|---|---|
| WO | 95/23258 | A1 | 8/1995 |
| WO | 2009/149705 | A2 | 12/2009 |

* cited by examiner

SYSTEM, UNIT AND METHOD FOR RECOVERING DEICING LIQUIDS FROM AIR-PORT APRON SURFACES

This application is a Continuation Application based on PCT/IB2017/057888, filed Dec. 13, 2017, which claims benefit of Serial No. PCT/IB2017/050512, filed Jan. 31, 2017 in the International Bureau and which application(s) are incorporated herein by reference. To the extent appropriate, a claim of priority is made to each of the above disclosed applications.

The present invention relates to a device and a method for recovering de-icing and/or anti-icing liquids from airport apron/deicing platform—surfaces.

BACKGROUND OF THE INVENTION/BACKGROUND ART

In connection with the removal of ice or from or ice prevention on surfaces of airplanes, a deicing or anti icing liquid is sprayed on the airplane Traditionally, removal of ice from airplanes is done in two main steps, the first step being a de-icing step, wherein ice and snow deposited on the surface of the airplane is removed, the second step being an anti-icing step, wherein the surface of the airplane is covered with a protective liquid, which precludes formation of new ice on the surface of the airplane. In case no ice has formed on the airplane, only the second step may be performed for prevention purposes.

The de-icing and the anti-icing liquids are typically a mixture of glycol, water and various further compounds, called additives.

In the de-icing step it is known to use a pre-heated liquid, which is a mixture of water and a so called Type 1 de-icing liquid. The Type 1 de-icing liquid has a low viscosity and it is primarily the thermal energy of the liquid, which causes the melting and removal of the ice (and possible snow deposits) from the airplane.

The anti-icing step is performed by applying a protective layer of anti-icing liquid on the surface of an airplane in order to prevent the formation of a new layer of ice on the surface of the airplane before it has left the apron/deicing platform.

Excess deicing and/or anti-icing liquid drains from the airplane, and will remain on the ground surface at the de-icing/anti-icing location, when the airplane has finished treatment.

Due to environmental considerations, a controlled emission is desired in many airports. Further, it may be desirable to collect excess de/anti-icing liquid for recycling purposes.

Today, typically the collection of excess deicing and anti-icing liquid from runways, aprons or specialized deicing platform surfaces is performed in airports by utilizing trucks equipped with heavy-duty suction devices. By the aid of vacuum, deicing/anti-icing liquid is sucked up through a nozzle and into a tank on the truck. The vacuum is build up by use of a large blower. In order to provide a sufficient vacuum and air speed, considerable power is needed, typically in the order of 250 to 350 kW. Further, application of a suitable vacuum requires a very precise control of the distance between the apron/deicing platform surface and the nozzle. This may be very difficult, especially if snow and ice mixed with liquid is present on the apron/deicing platform surface. An example of such trucks is disclosed in US 2010/0147331 A1.

With an increased focus on energy consummation reduction, it would be desirable to provide a more energy and cost efficient solution for removing and recollecting excess deicing/anti-icing liquids from apron/deicing platform surfaces in airports or other places where deicing/anti icing could take place.

However, when the deicing and/or anti icing process is needed, snow and ice further forms on the apron/deicing platform. Therefore, when the de-icing/anti-icing liquid is collected, snow, slush and/or lumps of ice, as well as debris/stones/gravel is introduced into and mixed with the de-icing/anti-icing liquid.

WO 95/14823 A1 discloses a truck with a horizontal axis, cylindrical brush, which sweeps water, de-icing liquid, ice, snow, slush, debris, gravel, etc. onto a transport elevator. The transport elevator is heated to melt ice, snow, and slush, and transport the swept components up to a first tank in the truck, where it is heated in order to melt any remaining ice, snow, and slush. From the first tank, the melted compounds may be transferred to a second container for storage via suitable piping and pumps. The disclosed truck is a cumbersome, intricate construction, and uses a large amount of energy and space for collecting and storing the collected compounds.

DISCLOSURE OF THE INVENTION

On this background, it is an object of the present invention to provide a simpler more energy and cost efficient method, system and unit for recovering deicing/anti icing liquids from airport apron/deicing platform surfaces. It is also an object of the invention to provide a more compact and manoeuvrable system for collection of snow, ice and anti/deicing liquid for airport aprons or runways, especially areas/surfaces dedicated to treating airplanes with anti-icing liquid and/or deicing liquid.

Further, it is an object to provide a system and unit which constitute an alternative to the traditional glycol suction vehicles.

It is a further object of the present invention to provide a de- and/or anti-icing liquid recovering method, system, and unit, by which many of the logistical problems mentioned above are alleviated.

In a first aspect of the invention this object is achieved by providing a liquid recovery system for recovering de-icing and/or anti-icing liquids from airport apron/deicing platform surfaces comprising:

- a deicing-liquid recovery unit moveable in a first direction;
- and
- a collection tank,
- wherein said deicing-liquid recovery unit comprises
- a rotatable brush;
- a baffle; and
- a collection tray fluidly connectable to said collection tank,
- wherein the rotatable brush is arranged to sweep an apron/deicing platform surface such that materials resting on the apron/deicing platform surface is forced over the baffle and into the collection tray,
- wherein a first conveyor is arranged in said collection tray and arranged for moving materials swept into the collection tray in a direction perpendicular to said first direction towards an exit port, and
- wherein said system further comprises a second conveyor for transporting collected materials from the exit port of said collection tray to said collection tank.

Thereby a very compact system is obtained, which will allow a vehicle equipped with or hauling the system to turn very sharply, and thereby provide a more efficient collection of materials from aprons. Further, by the arrangement of collection tray, thereby is obtained a more efficient sweeping of materials with decreased loss of swept-up liquids and snow and ice.

The collection tray may be formed as a part of a housing of said deicing/anti-icing liquid recovery unit or as a separate part, inserted in or insertible into a housing of the deicing/anti-icing liquid recovery unit.

The system may further comprise a vehicle, such a truck or tractor for towing or pushing the unit. It will be appreciated that the above-mentioned first direction corresponds to the longitudinal axis or longitudinal direction of the vehicle.

The inlet opening and the exit port may be formed in the collection tray and/or in the housing.

The materials to be swept from the airport apron/deicing platform surface are deicing and/or anti-icing liquid, water, snow, ice and slush, as well as gravel/debris/dirt. This material has two major constituents, a liquid constituent comprising deicing and/or anti-icing liquid and/or water, and a "dry" or solid-phase constituent, comprising snow, ice and gravel/debris/dirt.

In an embodiment the system further comprises an intermediary conveyor arranged between the exit port from the collection tray and an inlet chute of the second conveyor, and the intermediary conveyor transports the collected materials in a direction opposite to said first conveyor.

In an embodiment, the exit port from the collection tray is arranged through a front wall of the collection tray.

In an embodiment the rotatable brush is a horizontal axis cylindrical brush having a horizontal rotational axis A. The axis A is perpendicular to the above-mentioned first direction.

Thereby the first conveyor is arranged for moving materials swept into the collection tray in a direction parallel to the horizontal rotational axis, A, of the rotatable brush.

The collection tray is preferably arranged in front of the brush relative to the first direction (the direction of movement of a vehicle hauling said unit), and the baffle is arranged there in between.

Preferably, an external bottom side of the collection tray is arranged at a height between the surface of the apron and the height of the horizontal axis, A, of the cylindrical brush. In a further embodiment the first conveyor is an auger/screw conveyer. Thereby, a very efficient movement of solids mixed with liquids may be obtained. Further, an efficient expulsion mechanism is provided which at the same time transports the dry materials in one direction (which is preferably towards the exit port) and at the same time compressing the materials to press out the liquid constituents. This also increases the efficiency of the recovery of deicing/anti-icing liquid. For this purpose, the auger may be arranged along-side a mesh keeping back the "dry"/soli-phase materials and allowing the liquids to pass. A rotational axis B of the auger may be arranged parallel to a rotational axis A of a rotational horizontal axis cylindrical brush. Thereby a compact deicing/anti-icing liquid recovery unit may be obtained.

In a further embodiment, the second conveyor is an auger/screw conveyer.

In yet an embodiment, an external bottom side of the collection tray is configured to be located 3-100 cm, such as 5-50 cm, such as 5-20 cm, preferably 5-15 cm above ground, i.e. the airport apron/deicing platform surface during use of the deicing/anti-icing liquid recovery unit and system. This may be provided by suitable dimensioning of a frame, wheels and/or mounting means of the deicing/anti-icing liquid recovery unit. Thereby a low position of the collection tray is provided. Consequently, a more compact deicing/anti-icing liquid recovery unit may be obtained. Also, the low location of the collection tray allows to keep the collection tray away from heat sources of the machinery, to avoid heating of the swept up materials at least until they have been sorted. Further, the low location of the collection tray secures that the brush can more easily lift the liquid/wet and dry/solid phase material into the collection tray, and thereby avoid additional transportation of the liquid/wet and dry/solid material. Thereby, a more compact unit and system may be provided, which is further more easy to maintain or repair, and which uses less energy.

In yet an embodiment, an upper edge 12" of the baffle 12 is located at a height above the external bottom of the collection tray of 3-60 cm, such as 5-20 cm, and preferably 5-20 cm. Thereby a compact deicing/anti-icing liquid recovery unit may be obtained.

In a further embodiment, the system further comprises a pump and said sorting tray comprises means for retaining solid phase materials from said swept-up material in a first portion of said sorting tray and letting liquids from said swept-up material pass through and into a second portion of said sorting tray; and liquids collected in the second portion of said the sorting tray can be pumped to the collection tank via said pump.

In a yet further embodiment, the system may further comprise

- two or more collection tanks, and
- a control valve may be associated with each tank and arranged to control the fluid connection to each tank from the collection tray.

This allows to separation of liquids having different compositions. An example could be glycol concentration, where factions having a low glycol concentration could be directed into one collection tank and factions having a high concentration of glycol could be directed into another collection tank. This may simply be done by an operator of the system manipulating the valves based on e.g. a visual inspection of where on the apron/deicing platform spilt high and low glycol concentration are situated.

However, in a further embodiment the system may alternatively or additionally comprise

- a sensor configured for measuring a composition of liquids passing through a fluid connection from the collection tray to the collection tanks,
- a control system configured to receive input from the sensor and to provide a control signal to each of the control valves, and
- the control system may further be configured for distributing liquid to the collection tanks based on a measured composition of the liquid and a predetermined set of thresholds.

Thereby, the system allows automatically separating the collected liquid into factions, dependent on their composition. By measuring the glycol concentration in the collected liquid, the liquid may via suitable control valves be directed to the collection tank having a corresponding glycol concentration, thereby securing an optimized recycling of the glycol. The sensor may measure the selected measuring parameter, such as glycol concentration, continuously or in predetermined time intervals.

In a second aspect of the invention, the object may be obtained by a deicing-liquid recovery unit for a system according to any one of the embodiments described above.

The unit may be mounted on a vehicle such as a tractor or truck. The vehicle may provide power for operating the unit, and may further carry the one or more collection tanks, and the pump of the system as described above.

Thus, in an embodiment of the deicing-liquid recovery unit, it further comprises coupling means for attaching the deicing-liquid recovery unit to a vehicle, and means for coupling the collection tray to a pump and collection tank(s) arranged on the vehicle.

In a third aspect, the objects of the invention are obtained by a method for recovering de-icing and/or anti-icing liquids from airport apron/deicing platform surfaces, said method comprising:

- moving a rotational brush over an airport apron/deicing platform surface,
- sweeping materials comprising one or more of deicing and/or anti-icing liquid; water; ice; snow; and gravel from said airport apron/deicing platform surfaces and into a collection tray over a baffle by rotating said rotatable brush,
- moving materials swept into the collection tray in a second direction perpendicular to said first direction towards an exit port for removal of the collected materials, and
- transporting collected materials from said exit port to said collection tank.

In an embodiment, the method further comprises

- expelling said collected materials through an exit port in the first direction, and then
- moving the expelled collected material in a third direction opposite to said second direction, before transporting said collected materials to said collection tank.

The transporting of said collected materials to said collection tank may be done in a direction parallel with said first direction.

In a further embodiment, the method comprises arranging the collection tray (13) in front of a brush, in the first direction, and arranging the baffle there in between, such that the sweeping of materials is made over the baffle, and down into the collection tray.

In a further embodiment, the method comprises arranging an external bottom side of the collection tray at a height between the surface and the height of the horizontal axis of the cylindrical brush.

In an embodiment, the method further comprises

- separating liquid from solid-phase materials contained in said swept-up materials in said sorting tray, and
- pumping said liquids from said sorting tray and into a collection tank.

In an embodiment, the method further comprises selectively distributing portions of the liquid pumped from the collection tray into two or more collection tanks.

Thereby, separation of portions of the liquid materials having different compositions is allowed. An example of different compositions could be glycol concentration. Thus, factions of the liquid material having a low glycol concentration could be directed into one collection tank and factions having a high concentration of glycol could be directed into another collection tank. This may simply be done by an operator of the system manipulating valves associated with each collection tank, based on e.g. a visual inspection of where on the apron/deicing platform spilt high and low glycol concentration are situated.

However, in a further embodiment of the method the selective distribution of the liquid into the two or more collection tanks comprises

- measuring a composition of the liquid pumped from the sorting tray; and
- selectively distributing the liquid into the two or more collection tanks based on the measured composition and predetermined thresholds for a selected content of a component of the liquid.

Thereby, the method allows automatically separating the collected liquid into factions, dependent on their composition, e.g. the glycol concentration. By measuring the glycol concentration in the collected liquid, the liquid may via suitable control valves be directed to the collection tank having a corresponding glycol concentration, thereby securing an optimized recycling of the glycol.

In an embodiment thereof, a glycol concentration is measured and the liquid is distributed into one of the two or more collection tanks based on a predetermined glycol concentration threshold.

The measurement of the composition may be a continuous measurement.

In a fourth aspect of the invention, the method according to any one of the embodiments described above is applied in a system according to any one of the embodiments described further above.

In a fifth aspect of the invention, a de-icing and/or anti-icing liquid recovery system for recovering de-icing and/or anti-icing liquids from airport apron/deicing platform surfaces according to any one of the embodiments described above is used in a method a method for recovering de-icing and/or anti-icing liquids from airport apron/deicing platform surfaces according to any one of the embodiments of the method described above.

Further objects, features, advantages and properties of the de-icing and/or anti-icing liquid recovery system and unit, as well as the method according to the invention will become apparent from the detailed description.

BRIEF DESCRIPTION OF THE DRAWINGS

In the following detailed portion of the present description, the invention will be explained in more detail with reference to the exemplary embodiments with reference to the drawings, in which.

DETAILED DESCRIPTION OF THE INVENTION

Figure 1A:
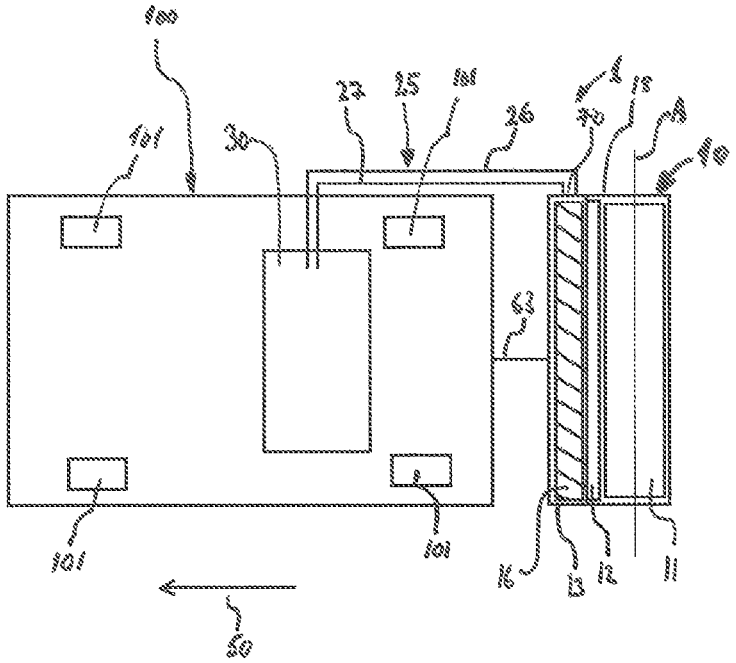
FIG. 1A is a diagrammatic depiction of a deicing liquid recovering system and unit according to an embodiment of the present invention.

In the following detailed description of the method, system and unit for recovering deicing liquid according to the invention will be described by the preferred embodiments.

Throughout, the detailed part of this description, for the sake of simplicity, reference will be made to deicing liquid. It will however be understood that both deicing and anti-icing fluid as well as other liquids will be and is intended to be recovered by the method, system and unit according to the invention.

FIG. 1 shows a first exemplary embodiment of a system 1 for recovering deicing liquid and a unit 10 for recovering deicing liquid. The system 1 comprises unit 10 for recovering deicing liquid and a first collection tank 30. The unit 10 comprises a rotatable brush 11, such as a rotatable horizontal axis generally cylindrical brush, a baffle 12, and a collection tray 13. The rotatable brush 11 has a horizontal rotational axis A. The brush 11 is arranged to sweep an apron/deicing platform surface 90, see e.g. FIG. 2, such that materials 91 resting on the apron/deicing platform surface 90 is forced over the baffle 12 and into the collection tray 13. The unit 10 may comprise a housing 18 forming a frame for the rotatable brush 11, the baffle 12, and the collection tray 13. The housing 18 may further at least partially encapsulate the rotatable brush 11, the baffle 12, and the collection tray 13.

A first conveyor 16, e.g. in the form of an auger is arranged in the collection tray 13. The first conveyor 16 is arranged such that it may transport/move materials swept into the collection tray 13 in a direction parallel to the horizontal rotational axis A of the brush, and towards an exit port 70 from the collection tray 13, and thereby also from the unit 10. Thereby the collected materials, collected in the collection tray 13, may be removed therefrom.

The system further comprises a second conveyor 26 for transporting materials from said exit port 70 to said collection tank 30. The second conveyor 26 may be an auger.

Figure 1B:
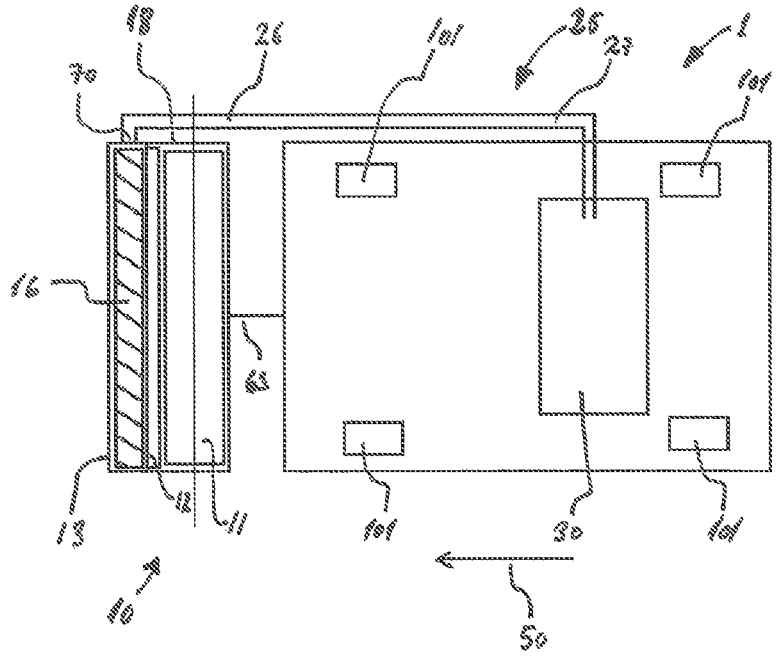
FIG. 1B is a diagrammatic depiction of a deicing liquid recovering unit according to a second embodiment of the invention.

In FIG. 1A the collection tank 30 is located on a vehicle 100, such as a truck. However, the vehicle 100 may also be a tractor or any suitable vehicle. The arrow 50 in FIG. 1A indicates a forward movement direction (a first direction) of the vehicle 100 and the unit 10. Arrow 50 defines a first direction of the system 1. Thus, in FIG. 1A the unit 10 for recovering deicing liquid is arranged as a trailer, trailing the vehicle 100. In FIG. 1B, an embodiment of the system 1 is shown, where the unit 10 for recovering deicing liquid is a front-mounted (front-runner) unit. Examples of such front mounted units 10 is shown in FIGS. 4, 5, 6 and 7, and will be described in further detail below.

It will be appreciated, that the unit 10 for recovering deicing liquid may—in not shown embodiments—be fully integrated into the vehicle 100 itself. However, it is desirable that the brush 11—especially when the brush is a horizontal axis rotatable brush—is arranged in a separate/individual unit 10 as shown, rather than on the vehicle. This is because in order to increase the efficiency of the sweeping up liquids, the diameter of the brush 11 need to be maximized. Thus, it is difficult to incorporate the system 1 in existing vehicle types.

Further, in not shown embodiments, the collection tank 30 may be located on a separate further vehicle, such as trailer.

It will also be appreciated that the second conveyor 26 forms part of a connection path 25 from the collection tray 13 to the collection tank 30. The connection path 25 may further comprise portions 27 which are flexible, to allow movement between the unit 10 and the vehicle 100.

Figure 8:
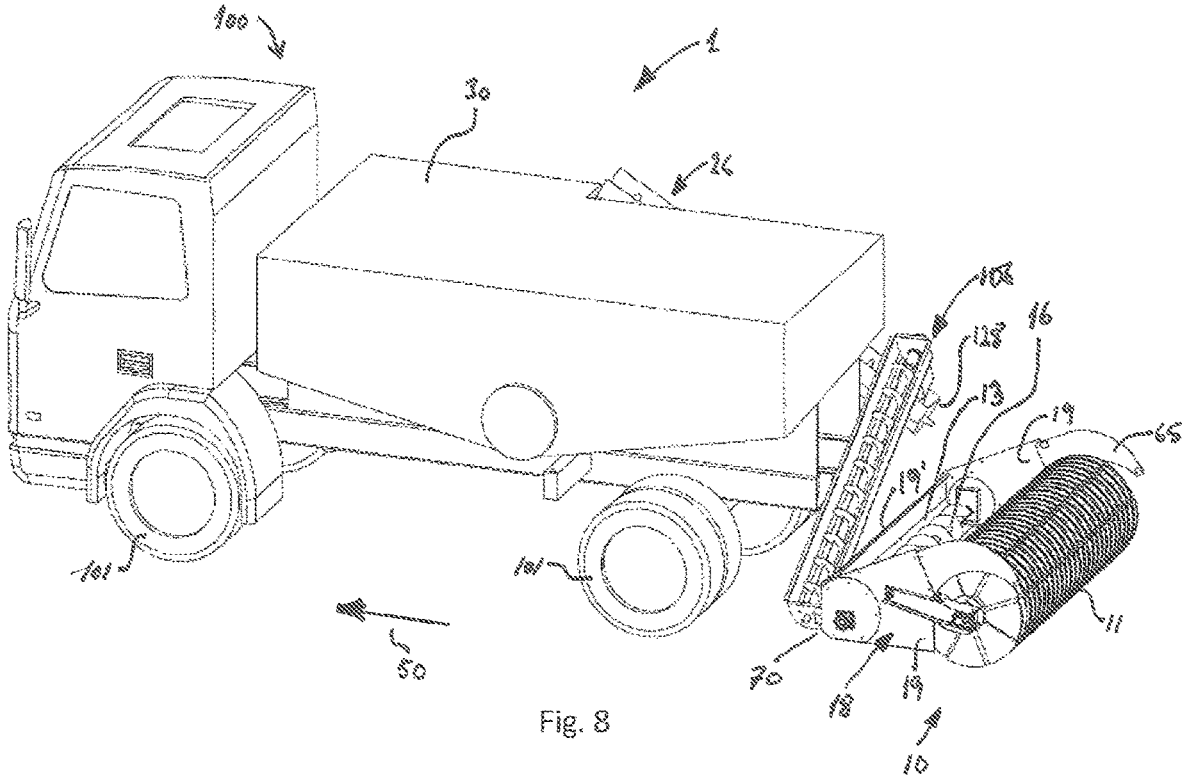
FIG. 8, in a perspective view, shows, a deicing liquid recovering unit similar to the deicing liquid recovering unit of FIGS. 6 and 7, but in a trailer configuration embodiment, and with cover portions detached, and the deicing liquid recovering unit being attached to a truck with a collection tank.

In the embodiments shown in FIGS. 1A and 1B, the system 1 is shown in diagrammatic form. Thus, when in FIGS. 1A-B, the connection path 25 with the second conveyor 26 is indicated as extending from the side of the vehicle 100 and the unit 10, this may not be so. At least portions of the connection path 25 will preferably be formed such that it extends within the boundaries defined by the chassis of the vehicle 100 and/or the unit 10, e.g., by extending over the unit 10 or vehicle 100. An example of such embodiments is shown in FIG. 8, which will be described in further detail below.

Figure 2:
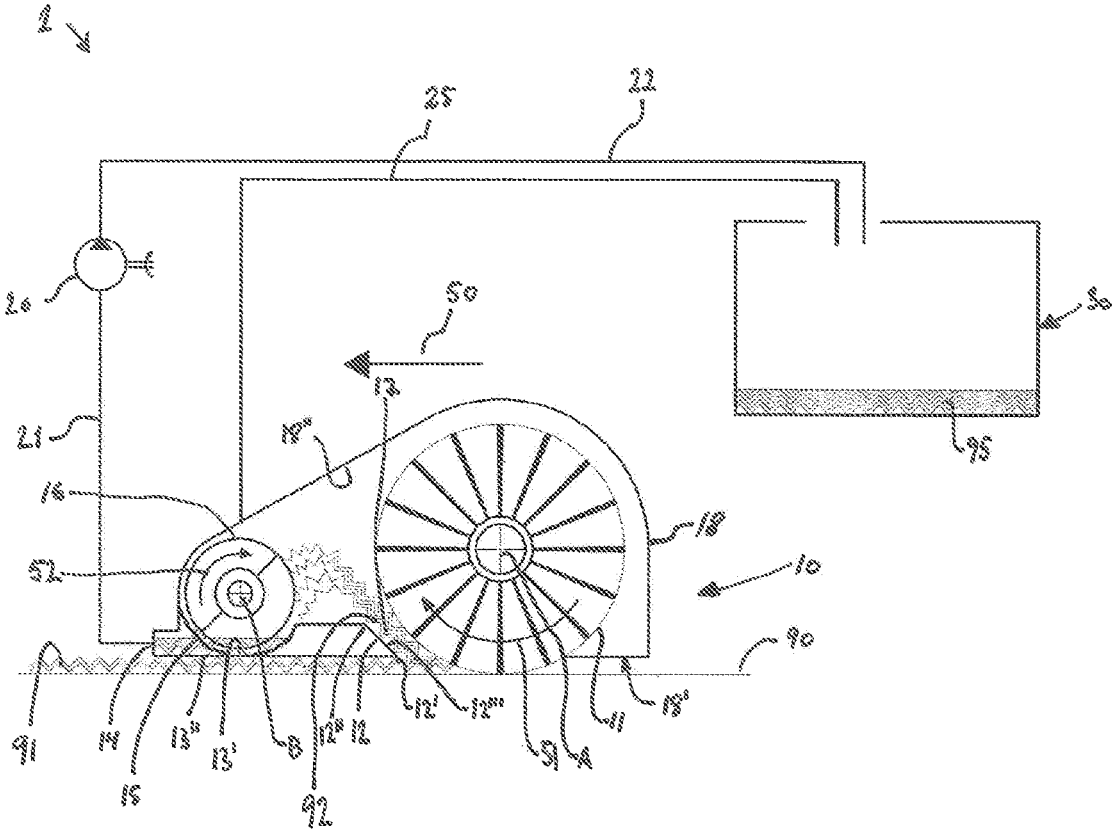
FIG. 2 is a diagrammatic depiction of a deicing liquid recovering unit and system according to a further embodiment of the invention.

Now, turning to FIG. 2, in which an embodiment of a system 1 and a unit 10 for recovering deicing liquid is shown. As in FIGS. 1A-B, the system 1 comprises a unit 10 for recovering deicing liquid and a first collection tank 30. The first collection tank 30 may be arranged on a vehicle 100 as described above. However, for the sake of simplicity, the vehicle is not depicted in the diagrammatic FIGS. 2 and 3. The unit 10 comprises a rotatable brush 11, such as a rotatable horizontal axis generally cylindrical brush, a baffle 12, and a collection tray 13. The rotatable brush 11 has a horizontal rotational axis A. The brush 11 is arranged to sweep an apron/deicing platform surface 90, such that materials 91 resting on the apron/deicing platform surface 90 is forced over the baffle 12 and into the collection tray 13.

A first conveyor 16, e.g. in the form of an auger is arranged in the collection tray 13. The first conveyor 16 is arranged such that it may transport/move materials swept into the collection tray 13 in a direction parallel to the horizontal rotational axis A of the brush, and towards an exit port 70 (see e.g. FIG. 4, 5, 6 or 10) from the collection tray 13 and thereby also from the unit 10. Thereby the collected material, collected in the collection tray 13 may be removed therefrom.

The system 1 further comprises a second conveyor 26 for transporting materials from the exit port 70 to the collection tank 30. The second conveyor 26 may preferably also be an auger. The second conveyor 26 forms part of a connection path 25 from the collection tray 13 to the collection tank 30. As described above in connection with FIGS. 1A-B, the connection path 25 may further comprise portions 27 which are flexible, to allow movement between the unit 10 and a vehicle 100, on which the collection tank 30 is arranged.

In these respects the system 1 shown in FIG. 2 is similar to the embodiments shown in FIGS. 1A-B. The system shown in FIG. 2 differs in that it also shows a set of optional additional features: The system 1 in FIG. 2 also has a pump 20, which may be located in the unit or on the vehicle 100 of the system 1. The pump 20 connects a first collection tank 30 with an outlet 14 arranged at a lower portion of the collection tray 13.

In an embodiment, the collection tray 13 is detachably connected to the housing 18 forming a detachable bottom portion thereof. In other embodiments, the collection tray forms a fixed bottom part of the housing 18. In yet other embodiments the collection tray 13 may be formed as closed structure, thereby defining a housing 18. Such an embodiment is illustrated in FIGS. 4-5 and 6-7.

The housing or cover 18 of the deicing-liquid recovery unit 10 comprises a surface 18" securing that brushed up liquid/snow/ice/slush will move in the direction of the collection tray 13. Surface 18" slopes down towards collection tray 13 from the brush 11 i.e. in the forward direction of movement (first direction 50). In the shown embodiments, FIGS. 2 and 3, the cover/housing 18 entirely covers the collection tray 13, the baffle 12 and the brush 11. However, in not shown embodiments, the housing/cover 18 only partially covers the brush 11, such as it may be appreciated from the embodiments shown in e.g. FIGS. 4 and 5, and FIGS. 6-7. The housing/cover 18 preferably at least extends from over the horizontal rotational axis (A) of the brush 11 and forward towards the baffle 12 and the collection tray 13. Preferably, the housing/cover 18 covers at least the baffle 12 and the collection tray 13.

The collection tray 13 is arranged in front of the brush 11 in the first direction 50 and the baffle 12 is arranged there in between.

The baffle/pan 12 comprises an inclined surface 12''', which is inclined relative to the surface 90 over which the unit 10 is moveable, and the inclined surface 12''' slopes away from brush 11.

Figure 3:
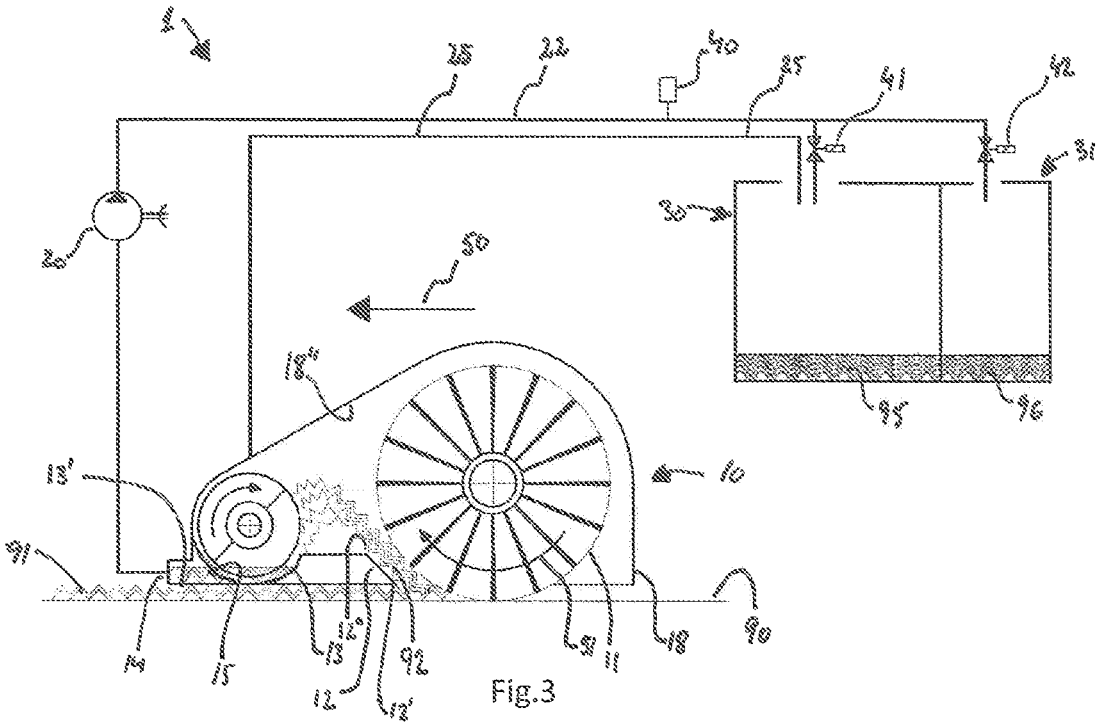
FIG. 3 is a diagrammatic depiction of a deicing liquid recovering unit and system according to a further embodiment of the invention.

In the embodiments shown in FIGS. 2 and 3, the collection tray 13 is connectable to the pump 20 via piping 21. Thereby, piping 21 fluidly connects an outlet 14 of the collection tray and an inlet of the pump 20. Further, the pump 20 is fluidly connected to the first collection tank 30 via piping 22.

As also discussed in connection with the embodiments of FIG. 1A-B, the unit 10 for recovering deicing and/or anti-icing liquid, shown in FIG. 2, may be mounted on or attached to a vehicle 100, such as truck or a tractor (not shown in FIG. 2). As shown in FIGS. 4 and 5 and FIGS. 6-7, the unit 10 may further comprises a frame 60 with wheels 61, 62. Thereby, the unit 10 may be connected to a vehicle 100, such as a truck or a tractor, via suitable connection/coupling means 63. In the embodiment shown in FIGS. 4 and 5, as well as in FIGS. 6-7, the unit 10 is configured for mounting in front of the vehicle 100. However, in other embodiments, the unit may alternatively be configured to trail the vehicle 100.

Preferably, the first collection tank 30 may be arranged on or trailing the vehicle 100. In alternative embodiments the first collection tank 30 may be formed on the unit 10. Preferably, the pump 20 is formed on the vehicle, or on a trailer carrying the first collection tank 30. Alternatively, the pump 20 may be formed on the unit 10. The piping 21, 22 is preferably at least partially formed as a flexible tubing, especially if the unit 10 and the collection tank 30 are arranged on separate parts.

Further shown in FIG. 2 is a surface 90, such as an airport apron/deicing platform surface. On the surface 90, a material 91 is deposited. The material 91 deposited on the surface 90 is a mixture comprising one or more of surplus deicing/anti icing liquid, ice, water, snow, slush, debris, gravel. The surplus deicing/anti icing liquid has drained of an airplane, which has been treated with deicing liquid or anti-icing liquid or both. When the surplus deicing/anti icing liquid drains of the airplane, it mixes with ice, snow, slush, water, and/or debris/gravel already on the surface 90.

In order to remove the surplus deicing/anti icing liquid it is necessary to remove first all the material 91 on the surface 90 including the drained-of deicing and anti-icing liquid. This is done by moving the system 1, or at least the unit 10, over the surface 90, while rotating the rotatable brush 11. This situation is illustrated in FIGS. 1A-B and 2-3 by the arrow 50, indicating the movement direction of the unit 10 relative to the surface 90. In FIG. 2, the arrow 51 indicates a rotation direction of the rotatable brush 11.

As may be appreciated from FIG. 2, the rotatable brush 11, the baffle 12, and the collection tray 13 are arranged relative to each other such that, when the unit 10 passes over a surface 90 such as an airport apron or deicing platform surface, materials 91 deposited on the surface 90 are swept over the baffle 12 and into the collection tray 13 by rotating the rotatable brush 11. The rotatable brush 11 brushes the materials through an inlet opening 17, which in the embodiment shown in FIGS. 1-3 is provided through a housing 18 in which the collection tray 13 is arranged. In other embodiments, a similar inlet opening 17 may be provided into the collection tray 13 in embodiments, where the collection tray 13 is formed as a closed structure, and thus defines a housing 18 by itself, as e.g. illustrated in FIG. 4. The inlet 17 is formed through the bottom 18' of the housing and between the collection tray 13 and the brush 11.

As can be appreciated from the figures, the collection tray 13 is formed in front of the brush 11 relative to the forward direction of movement 50 of the unit 10 and the vehicle 100.

The rotatable brush 11 rotates about an axis A, which in this embodiment is perpendicular to the movement direction 50 of the unit 10 relative to the surface 90, and parallel to the surface 90, i.e. horizontal.

The baffle 12 preferably comprises an inclined surface 12''' having a lower edge 12' and an upper edge 12".

In FIG. 2, the material 91 passing over the inclined surface 12''' of the baffle 12 is indicated with the reference number 92. The material swept into the collection tray 13 is—as implied above—a mixture of liquid and solid substances. By liquids are meant water, fluid deicing or anti-icing liquid, and to a certain degree slush. By 'dry' or 'solid phase' substances is meant snow and ice (solid-phase water), and debris/gravel.

As indicated in FIG. 2, the dry/solid phase substances 93 will accumulate in the upper portion of the collection tray 13, while portions of the fluid substances 94 will drain to the bottom 13' of the collection tray 13.

As shown in FIGS. 2 and 3, there may be a horizontally arranged grid/mesh/filter 15 or the like—separating the collection tray 13 in two parts a bottom or lower portion and an upper or top portion.

The liquids draining to the bottom 13' of the collection tray may as shown in FIG. 2 be removed via an outlet 14 by use of the pump 20. The pump 20 pumps the liquids into the first collection tank 30.

It is clear that the piled up materials indicated with reference number 93 in FIGS. 2 and 3 contains both liquid/fluid substances/materials and dry/solid phase substances/materials, but the piled up materials will begin to drain off quickly, either passively via the filter, or actively in combination with the first conveyor 16, which may to a certain degree squeeze or press the materials 93. Therefore for the sake of simplicity, the materials indicated by reference number 93, are referred to as dry/solid phase substances/materials while the materials indicated by reference number 94 are referred to as drained-of liquid/fluid materials/substances, i.e. water and deicing/ant-icing liquid.

However, as explained above, the outlet 14 and pump 20 are optional. In general the materials 93 collected in collection tray 13 are continuously moved by the first conveyor 16 toward the exit port 70 formed at one side of the unit 10, and further via the connection path 25, including at least the second conveyor 26. The second conveyor 26 may, as mentioned, be a screw conveyor/auger, and the collection tray 13 be formed as semicircular/cylindrical chute. At least in embodiments, where the unit 10 and system 1 does not have a filter 15 (and pumps 20 etc.), liquid melted from the collected material 93 will be trapped by the solid components of the collected material 93, such as the snow and ice and transported along with these by the first conveyor 16. The snow and ice will form a barrier between the windings of the auger of the first conveyor 16 and the inner wall of the collection tray 13, whereby any liquid component will be forwarded towards the exit/outlet port 70 from the collection tray 13, when the auger rotates 52.

The materials 95 accumulated in the first collection tank 30, including liquids, may be retrieved for further processing, such that the deicing and/or anti-icing liquids may be extracted and disposed of in an environmentally safe way or recycled.

The unit 10, shown in FIG. 2, with the filter 15, the outlet 14 and the pump 20 thus comprise means for separating the solid substances from the fluid substances swept into the collection tray 13, already while the collection is going on.

The means for separating the solid substances from the fluid substances swept into the collection tray 13 may, as described above, be a simple horizontally arranged grid/mesh/filter 15, but other means are conceivable. The grid/mesh/filter 15 preferably is shaped such that it follows the contour of the collection tray. Thus, as in the shown embodiments, the grid/mesh/filter 15 may replace portions of the semi-circular/cylindrical chute forming the collection tray 13.

The outlet port 70 from the unit 10 is may be formed through a sidewall 19 (see FIG. 4) in the housing 18 of the unit 10.

The means for expelling the accumulated/collected substances from the collection tray 13 of the unit 10, i.e. the first conveyor 16, may take on several different forms. They may in a simple embodiment (not shown) be formed by a scraper, actuable in a direction towards the above-mentioned outlet port 70. The scraper may be arranged to scrape over a horizontally arranged grid/mesh/filter 15 in embodiments having such a horizontal grid/mesh/filter 15, or a certain predetermined height over the bottom 13' of the collection tray 13. The scraper may be actuated by suitable means such as linear actuators, or by being arranged on an endless conveyer belt (not shown) arranged above the collection tray 13. In alternative embodiments (not shown), a horizontally arranged grid/mesh/filter 15 or portions thereof may be configured as an endless conveyor belt with transverse flanges/scrapers, and arranged to transport solids (ice/snow/slush) towards the outlet port 70. In further alternative embodiments (not shown), an endless conveyor belt, e.g. with transverse flanges/scrapers, may transport the collected materials 93 (ice/snow/slush/liquid etc.) towards the outlet port 70. In yet further embodiments (not shown), one or more brushes may be configured to expel the dry/solid phase materials via the outlet port 70. However, preferably the means for expelling the accumulated/collected substances from the collection tray 13 of the unit 10, i.e. the first conveyor 16, is an auger As shown in FIG. 2 the baffle 12 may define a depth of the collection tray 13.

The rotatable brush 11 is preferably a rotatable, horizontal axis, generally cylindrical brush 11 as shown in FIGS. 1-11. However, in other (not shown) embodiments, the rotatable brush may alternatively be a set of vertical axis brushes.

In the FIG. 2 embodiment, the first conveyor 16 is in the form of an auger (screw conveyor), which has a rotation axis, B, perpendicular to the motion (represented by arrow 50) of the unit 10, and parallel to that of the rotating brush 11, which in this example is a rotatable horizontal axis cylindrical brush. The auger 16 is rotatable (indicated by arrow 52) to provide transportation of the liquid as well as dry or solid phase materials (ice, snow) sideways out of the unit 10, through an outlet port 70 (see e.g. FIG. 4), formed in a sidewall 19 of the housing of the unit 10, i.e. the solid phase materials 93 are transported in a direction along axis B. Preferably, the outlet port 70 is provided such that it has a lower edge 70', which is formed, such that it has a height substantially corresponding to the height of the baffle 12, in order to prevent liquids to spill out of the outlet port. A second filter may further be provided to prevent ice and snow from entering the outlet 14 of the collection tray 13, and to secure the sorting of the wet and the dry portions of the collected material. The mesh/grid/filter 15 in the FIG. 2 embodiment may be a rounded structure following the cylindrical outer structure defined by the helix of the rotatable screw conveyor/auger 16.

In further embodiments, and as illustrated in FIG. 3, the first collection tank 30 may be supplemented with a second collection tank 31, or—in not shown further embodiments—with more additional collection tanks. The same reference numbers refer to the same parts as in FIGS. 1 and 2.

Thereby, a liquid portion 94 of the collected material 93, including the deicing/anti-icing liquid may be separated, dependent on composition of the deicing/anti-icing liquid, e.g. the glycol concentration of the collected liquid passing through the piping 21, 22, or simply an already liquid portion 94 of the collected materials 93 may be passed into a second collection tank 31, while a portion of the collected materials 93 comprising only or mainly solids (ice/snow/debris) may be delivered to the first collection tank 30. In a further embodiment, the glycol concentration of the liquid portion may be measured by a sensor 40. In order to control the collection of deicing/anti-icing liquid with different composition (such as glycol concentration), the sensor 40 is further connected to a set of valves, preferably one for each collection tank 30, 31, i.e. a control valve 41 for first tank 30 and control valve 42 for second tank 31, respectively. Preferably, the sensor 40 and the valves 41, 42 are connected via a suitable electronic control system. The sensor 40 is configured for measuring the composition of the liquid passing the sensor 40 and the electronic control system is further configured to control the opening and closing of the valves 41, 42 according to a predetermined scheme, to fill either of the collection tanks 30, 31, based on information received from the sensor 40. Thereby an optimized recycling of the deicing/anti-icing liquid may be obtained.

The sensor 40 may measure the composition of the passing liquid continuously or in regular time-intervals. Preferably, the sensor measures a glycol concentration.

FIG. 3 further shows collected material 95 in first collection tank, and a recovered/recovered liquid 96 including deicing/anti icing liquid in second collection tank, where the liquids 95 and 96 may e.g. have different concentrations of glycol.

Figure 4:
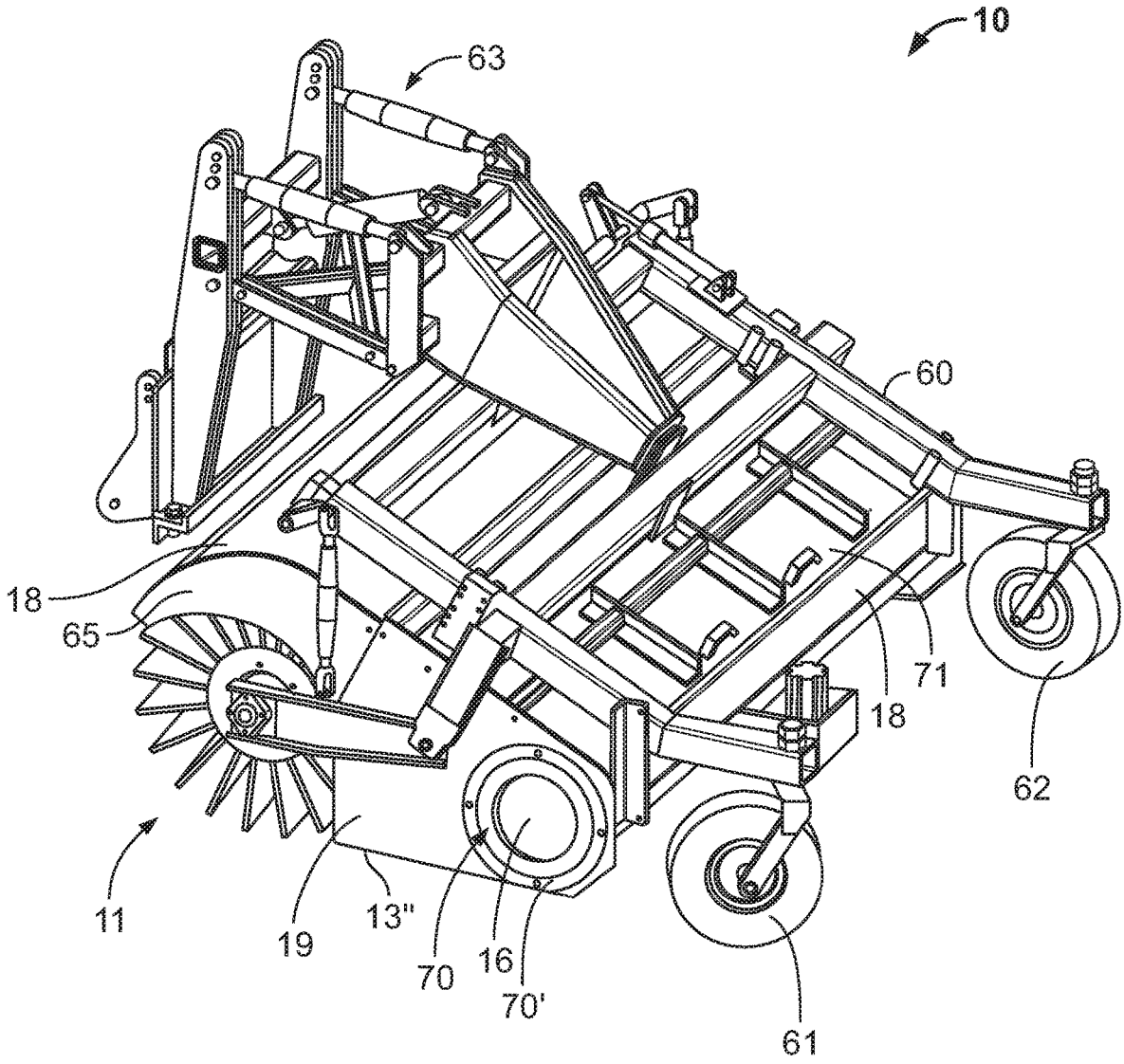
FIG. 4, in a perspective view, shows a deicing liquid recovering unit according to a further embodiment of the invention.

FIG. 4 shows a deicing liquid recovery unit 10 according to the invention. The same reference numbers refer to the same parts as in FIGS. 1, 2 and 3. The unit 10 has a rotating brush 11, a baffle (not shown in FIG. 4, but is preferably like the one described in connection FIGS. 1-3), and a collection tray 13. The unit 10 in FIG. 4 is configured as a front-runner to be mounted in front of a vehicle 100, such as a truck or a tractor, or the like, via a mount/coupling means 63. The unit 10 has a frame 60 to which the housing 18, the rotating brush 11, the baffle (not shown in FIG. 4), and the collection tray 13 is assembled. The frame 60 is further configured with wheels 61 62 to support the unit 10 during use, and secure that the rotating brush 11, etc. is maintained at a desired level (height) above the surface 90. The unit 10 shown in FIG. 4 is connectable to one or more collection tanks 30, 31 as described above. In this embodiment, the first collection tank 30, the optional second collection tank 31, the second conveyor 26 and the optional pump 20 are preferably located on the vehicle (not shown) and connectable to the unit 10 via a suitable piping (not shown).

Also shown in FIG. 4 is the exit/outlet port 70, which in this case is formed in/through a sidewall 19 of the collection tray 13/housing 18. In this embodiment, the collection tray 13 is a closed box shaped structure, defining a portion of the housing 18. However, inside (not shown), the collection tray 13 may have a semi-cylindrical portion as described above, which matches the shape of windings of the auger 16 (the first conveyor 16), which in FIG. 4 is visible through the exit/outlet port 70.

The exit/outlet port 70 is connectable with a second conveyor 26, not shown in FIG. 4. Suitable coupling means on/in the vicinity of the exit/outlet port 70 may be adapted for connecting the exit/outlet port 70 to such a second conveyor.

In order to guide the swept-up materials 91 to an inlet opening 17 (not shown in FIG. 4), the unit 10 further comprises a guard or guide plate 65 on each side of the ends of the cylindrical rotatable brush 11.

Further, FIG. 4 shows access doors 71 providing access to the interior of the housing 18 and the collection tray 13, and to the auger 16. However, the access doors 71 also may provide access for an operator of the system 1/unit 10 to manually brush out or shovel away snow/ice/dry materials 93 from collection tray 13 and/or from the optional mesh/grid/filter 15 (not shown in FIG. 4).

Figure 5:
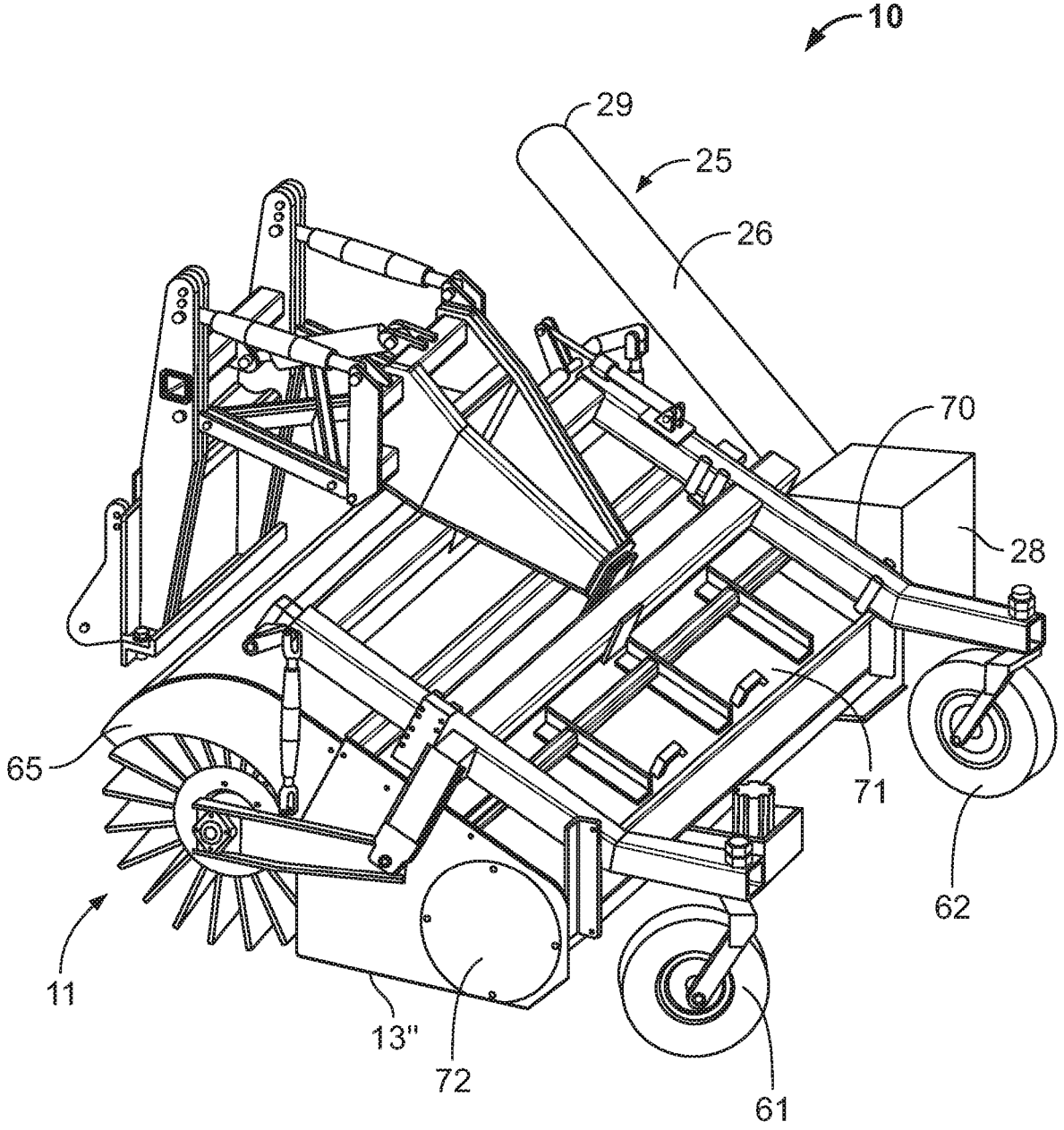
FIG. 5, also in a perspective view, shows a deicing liquid recovering unit according to a further embodiment of the invention.

FIG. 5 shows another embodiment of the unit 10 according to the invention. This embodiment is generally similar to the embodiment shown in FIG. 4. The FIG. 5 embodiment differs from that of FIG. 4 in that the exit/outlet port 70 is located at an opposite side of the unit 10. The first conveyor transports collected materials 93 in the direction of the exit/outlet port 70. FIG. 5 further illustrates that in an embodiment an additional access port 72 may provide access to the first conveyor 16 (not shown in FIG. 5). FIG. 5 further shows a second conveyor 26, which may be connected to the exit/outlet port 70 through an intermediate connector 28, which may—as shown—be located on the side of the unit. As mentioned above, however, the second conveyor 26 may connect to the collection tray at a location within the boundaries defined by the frame 60/housing 18 of the unit 10, in order to provide an even more compact unit 10.

In preferred embodiments, the second conveyor 26 is an auger (screw conveyor) formed in a closed tube. However, other means for transporting the collected material 93 to the collection tanks 30, 31 are conceivable, such as one or more of belt conveyors and a pipe/pump combination.

Also shown in FIG. 5 is a distal end 29 of the second conveyor 26. The distal end may be connectable to further portions of the above-mentioned connection path 25 from the collection tray 13 to the collection tank 30, such as e.g. a flexible portion 27. It will be appreciated that the length of the second conveyor 26 may longer or shorter than it appears in FIG. 5. The length depends e.g. on the location of the collection tank 30 on the vehicle 100.

A common feature of the embodiments of the invention, is that deicing/anti-icing liquid along with snow, ice etc. is brushed/swept up from the surface 90 by a rotating brush 11, and that the collected deicing/anti-icing liquid as well as ice and snow collected at the same time enters a collection tray 13, from where the liquid materials and the dry/solid phase materials may be sorted, and from which the liquid materials and the dry/solid phase materials may be pumped/transported to one or more collection tanks 31,32. It is also a common feature that the collected materials are initially moved sideways relative to the direction of movement 50, This feature contributes to allowing the construction of a compact, maneuverable deicing liquid recovery unit 10 and system 1.

As may be appreciated from the drawings, the collection tray 13 is level (relative to surface 90) with the rotating brush 11 during use. Preferably, the external bottom side 13" of the collection tray 13 is close to the ground/surface 90 during use, such as 3-100 cm, such as 5-50 cm, such as 5-20 cm, and preferably 5-15 cm above the surface 90, and parallel thereto. In embodiments, where the rotating brush 11 is a horizontal axis cylindrical brush, as shown in FIGS. 1-4, the external bottom side 13" of the collection tray 13 is preferably arranged at a location between the surface 90 and the height of the horizontal axis, A, of the cylindrical brush 11.

By providing a low location for the collection tray 13, a very compact deicing/anti-icing recovery unit may be obtained. This also allows to keep the swept-up materials away from heat sources in the machinery, whereby the temperature of the swept-up materials may be maintained at the lowest possible temperature in the collection tray 13 at least until it has been sorted. This may aid the separation of the liquid/wet and the dry/solid phase materials in the collection tray 13, or in the collection tank 30, where the wet materials are deicing/anti-icing liquid and water from melted ice and snow, and where the dry/solid phase materials are snow, ice. Further, providing a low location of the collection tray 13 secures that the rotational brush 11 can more easily lift the liquid/wet and dry/solid phase material 92 into the collection tray 13, which improves the efficiency of the removal of materials 91 from the surface 90, especially a liquid portion. Thereby, a more simple, compact and robust unit 10, with fewer movable parts may be obtained, and the energy consumption may be reduced.

Gravel/dirt/debris is preferably expelled with the snow and ice, but dependent on the mesh/grid 15 size, some may accumulate at the bottom of the collection tray 13 or on the mesh/grid 15 (in embodiments, where such a filter 15 is present). Thereby, the gravel/dirt/debris may be emptied/cleaned via the access doors 71, 72 formed in e.g. a top surface of the unit 10 (FIGS. 4 and 5), or through a sidewall 19 (FIG. 5). Since airport apron/deicing platforms (surface 90) are normally kept very clean from gravel/dirt/debris this is not expected to be necessary very often.

In order to secure that the materials 91 swept from the apron/deicing platform surface 90 enters the collection tray 13, the upper edge 12" of the baffle 12 preferably is located at a height above the external bottom 13" of the collection tray 13 of 3-60 cm, such as 3-20 cm and preferably 3-15 cm. The upper edge 12" of the baffle 12 is parallel to the surface 90 (horizontal) during use of the unit 10. The baffle is preferably comprises an inclined plate/flange that forms a slope for the materials 92 entering the collection tray. The lower edge 12' of the baffle may—in not shown embodiments—extend below the external bottom 13" of the collection tray 13. The lower edge 12' of the baffle 12 is parallel to the surface 90 (horizontal) during use of the unit 10.

In order to ensure that the baffle, the collection tray 13 etc. are located in the corrected height, either the mount/coupling means 63 or the wheels 61, 62 may be adjustable to correct to a desirable height.

It will be appreciated that the collection tray 13 and the baffle 12, optionally the means for sorting 15, and the means for expelling/first conveyor 16 are formed in the housing 18. The rotating brush 11 may be enclosed in the housing as shown in FIGS. 1-3 (only a part of the rotating brush 11 extending through an inlet opening 17 through the bottom 18' of the housing 18). In other embodiments, and e.g. as illustrated in FIGS. 4-7, the rotating brush 11 is connected to the frame 60 in connection with an inlet opening (not shown in FIG. 4) in the housing formed at the baffle 12. The inlet opening 17 to the housing 18 therefore in either case functions as an inlet opening to the collection tray 13.

The materials collected in the collection tank 30 may—when the sweeping has been terminated or when the collection tank 30 is full—be delivered to a facility/plant, where the solid portions—ice and snow—may be melted, and where the anti-/deicing liquid may be separated from the water content of the collected materials 93, 95, 96. Alternatively or additionally, the collection tank 30 may be equipped with heating devices in order to melt the solid part—ice and snow. Alternatively or additionally, the collection tank 30 may be equipped with means for separating water and deicing/anti-icing liquid. In an alternative thereto, the first collection tank 30 may be equipped with a filter so that the solid material will remain on the filter and the liquid part will drained off. This liquid part may e.g. be transferred to a second collection tank 31. When the ambient temperature is below 0° C. it must be assumed that the liquid portion may have a higher concentration of anti/deicing liquid. Therefore, a filter in the first collection tank 30 for separating of the liquid portion may make the extraction of anti/deicing liquid more efficient. The anti/deicing liquid contained in the solid portion (snow/ice) may in this case be extracted in an external facility/plant as described in the opening of this paragraph.

In yet further embodiments, the first and/or the second collection tanks 30, 31, may comprise or be connected to equipment for extracting anti/deicing liquid.

Figure 6:
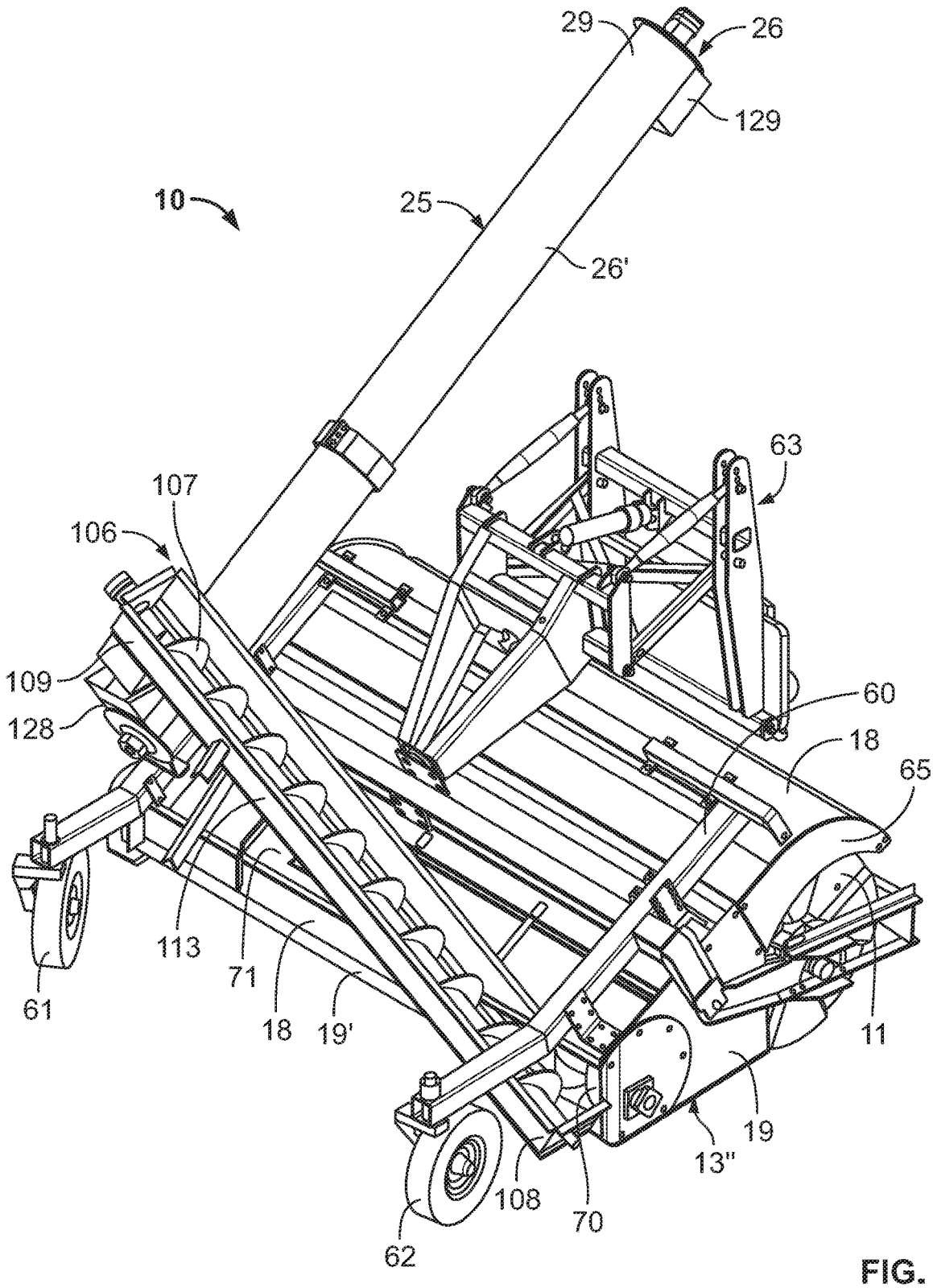
FIG. 6, in a perspective view, shows an alternative embodiment of a deicing liquid recovering unit according to the invention in a front runner configuration.
Figure 7:
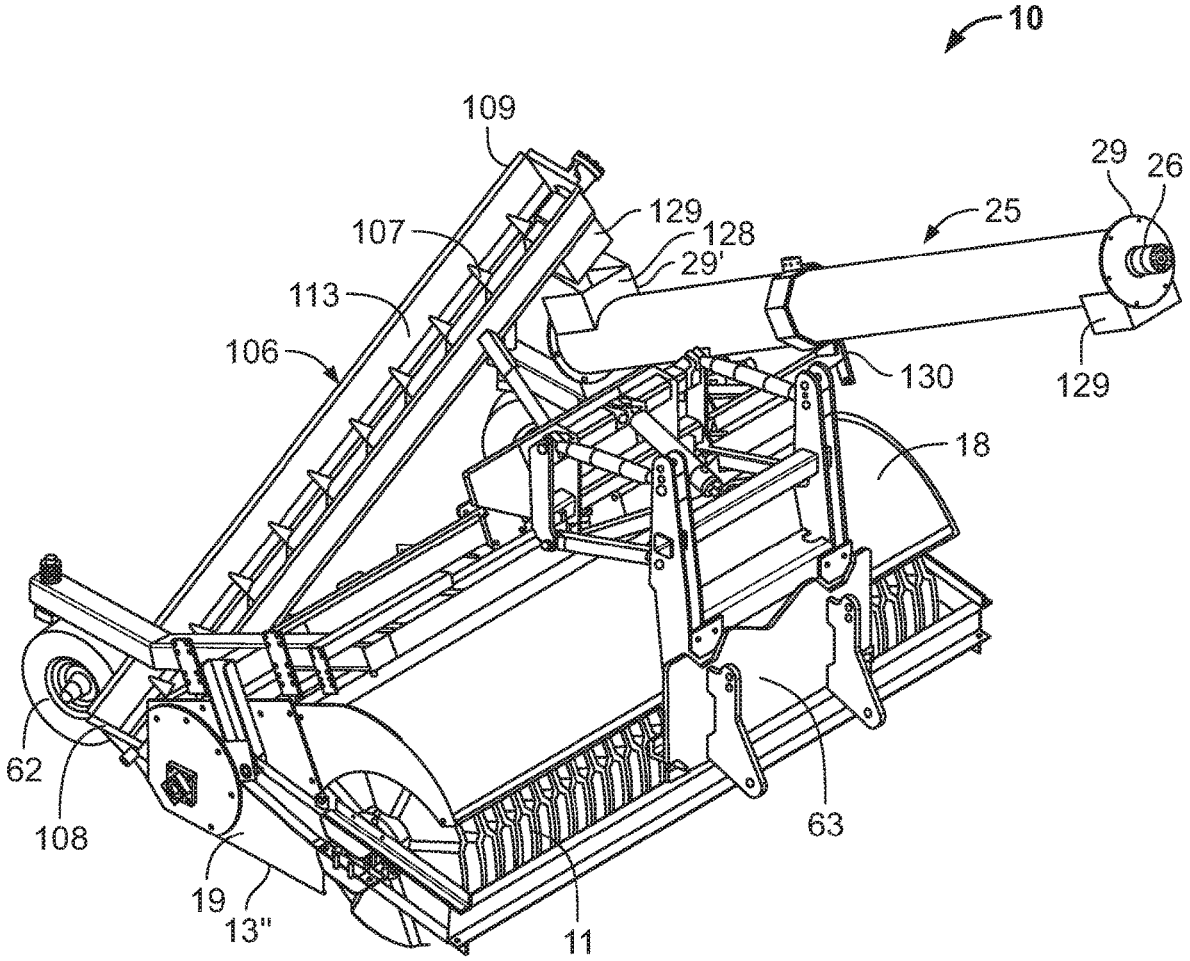
FIG. 7 shows the deicing liquid recovering unit of FIG. 6, seen from an opposite view.

FIGS. 6 and 7 depicts a further embodiment of the deicing liquid recovery unit 10 for a further embodiment of the deicing liquid recovery system 1 according to the invention. The same reference numbers refer to the same parts as in FIGS. 1-5.

As is the case with the embodiments described in connection with FIGS. 4 and 5, the deicing liquid recovery unit 10 in the FIGS. 6 and 7 embodiment comprises. a rotating brush 11, a baffle (not shown in FIGS. 6-7, but is preferably like the one described in connection with the FIGS. 1-5 embodiments), and a collection tray 13. The unit 10 in FIGS. 6-7 is configured as a front-runner to be mounted in front of a vehicle 100, such as a truck or a tractor, or the like, via a mount/coupling means 63, as also described above.

The unit 10 has a frame 60 to which the housing 18, the rotating brush 11, the baffle (not shown in FIGS. 6-7), and the collection tray 13 is assembled. The frame 60 is further configured with wheels 61 62 to support the unit 10 during use, and to secure that the rotating brush 11, etc. is maintained at a desired level (height) above the surface 90. The unit 10 shown in FIGS. 6-7 is connectable to one or more collection tanks 30, 31 as described above. In this embodiment, the first collection tank 30, the optional second collection tank 31, and the optional pump 20 may be located on the vehicle (not shown) and connectable to the unit 10 via a suitable piping (not shown), alternatively they may be formed on the unit 10 (not show). In the FIGS. 6-7 embodiment a second conveyor 26, forming at least a portion of the pathway 25 between the collection tray 13 inside the housing 18 of the unit 10, and the collection tank 30, is formed as part of the unit 10. However, alternatively it may form part of or be connected to the vehicle 100 to which the unit 10 is connectable. In any case it forms part of the system 1.

In this embodiment, the collection tray 13 is a closed box shaped structure, defining a portion of the housing 18. However, inside (not shown), the collection tray may have a semi-cylindrical portion as described above, which matches the shape of windings of the auger 16 (the first conveyor 16), which in FIG. 6 is not visible.

Also shown in FIG. 6 is an exit/outlet port 70 from the collection tray 13. In this embodiment the exit/outlet port 70 is not formed in/through a sidewall 19 of the collection tray 13/housing 18, but in a front wall 19' perpendicular thereto. Thus, in the FIGS. 6 and 7 embodiment the collected materials 93 collected in the collection tray 13 is (continuously) moved sideways relative to the direction of movement 50 of the system 1/unit 10 vehicle 100, and in a direction towards a sidewall 17 of the housing 18 of the collection tray 13/housing 18, Do to the continuous movement of collected materials 93 in the collection tray 13 the collected material will be pushed out of the opening/exit/outlet port 70 in/through the front wall 19'. It will be appreciated that the opening/exit/outlet port 70 is arranged in/through the front wall 19' at a location to the side of the unit 10, adjacent to a sidewall 19 thereof.

The collected material 93, which in this manner is expelled through the outlet port 70 is received in an intermediate (third) conveyor 106. The third conveyor transports the collected materials 93 from the outlet port 70 to the second conveyor 26, as will be described in further detail below.

It will be appreciated that the third conveyor 106 forms thereby will form part of the connection path 25 from the collection tray 13 to the collection tank 30, as described above in connection with the embodiments shown in FIGS. 1-5. The connection path 25 may further comprise portions 27 which are flexible, to allow movement between the unit 10 and the vehicle 100.

The third conveyor 106 is preferably an auger (screw conveyor). However, other means for transporting the collected material 93 from the outlet port 70 to the second conveyor 26 are conceivable, such as one or more of belt conveyors and a pipe/pump combination.

In FIGS. 6 and 7, the third conveyor 106 is shown as an open conveyor comprising an elongate tubular (semi-cylindrical) bottom 113 and a helical screw 107. It will however be appreciated that in alternative embodiments, the third conveyor may be arranged in a closed tubular system.

The third conveyor 106 has a first end 108 and a second end 109, opposite thereto. The first end is connected to the outlet port 70, such that collected materials 93 are received in the third conveyor 106 for transportation towards the second end 109. The third conveyor 106 is preferably inclined relative to horizontal. The inclination is preferably 5-30°, such as 20-30°. In preferred embodiments, the inclination is adjustable between 5-30°.

The exit port 70 may be arranged at height, with the lowest edge at or above a level of upper edge 12" of the baffle 12. The housing/cover 12 of the unit 10 may be shaped such that the collected materials 93, which a transported by the first conveyor towards exit port 70 is pressed out of the exit port 70 and onto the intermediate third conveyor by the movement of the first conveyor 16. However, in other embodiments (not show) a mechanism for expulsion of the collected materials 93, accumulating at the exit port 70, may be provided. Such a mechanism may be provided by a brush, an arm, a shovel actuated e.g. by a linear actuator, or a further screw conveyor.

The collected materials 93, which a transported by the first conveyor towards The second end 109 of the third conveyor is connectable to an inlet chute 128 of the second conveyor 26.

Thus in these embodiments, the exit/outlet port 70 from the collection tray 13 is connectable with the second conveyor 26, via the third conveyor 106. This arrangement allows that the width of the unit 10 can be minimized, such that the total width is approximately the same as the width of the brush 11. This is because the configurations allows that no parts of the pathway 25 from the outlet port 70 to the collection tank 30 extends sideways of the unit beyond approximately the width of the cylindrical rush 11.

In FIGS. 6 and 7, the second conveyor 26 is depicted as a closed system. Inside the closed tubular housing 26', the second conveyor 26 comprises a screw, which is not visible in the figures. It will however be appreciated, that in other—not shown—embodiments, the second conveyor may be an open conveyor.

The second conveyor 26 is an elongate structure having a first end 29' and a second, distal end 29 opposite thereto, and a longitudinal axis. The above-mentioned inlet chute 128 is arranged at the first end 29'. Further, second conveyor 26 is attached to the unit 10 via suitable adjustable connection means 130. Preferably, the adjustable connection means 130 allows adjustment of the vertical inclination of the second conveyor 26. Preferably, the adjustable connection means 130 also allows adjustment of the second conveyor, such that the longitudinal axis of the second conveyor 26 is adjustable relative to the direction of movement 50 of the unit 10 and vehicle 100 in the horizontal plane, At the distal end 29 of the second conveyor 29, the second conveyor 26 has an outlet 129. The outlet is connectable to an inlet (not shown) of a collection tank 30 on the vehicle 100, e.g. via a flexible pipe (not shown). At least the outlet 129 may be brought into alignment with the inlet to the collection tank, such that the collected materials 93 may be transported from the collection tray 13 to the collection tank 30.

In order to guide the swept-up materials 91 to an inlet opening 17 (not shown in FIGS. 6 and 7), the unit 10 further comprises a guard or guide plate 65 on each side of the ends of the cylindrical rotatable brush 11.

Further, as with the FIGS. 4-5 embodiments, the FIGS. 6-7 embodiments may comprise access doors 71 providing access to the interior of the housing 18 and the collection tray 13, and to the auger 16. However, the access doors 71 also may provide access for an operator of the system 1/unit 10 to manually brush out or shovel away snow/ice/dry materials 93 from collection tray 13 and/or from the optional mesh/grid/filter 15 (not shown).

FIG. 7 shows the same unit 10 as FIG. 6, but in a rear view, where FIG. 6 shows the unit 10 in a front view.

As with the previous embodiments, in the FIGS. 6-7 embodiments the first conveyor transports the brushed-up, collected materials 93 in the direction of the exit/outlet port 70, transverse of the direction of movement 50. However, the exit/outlet port 70 is arranged in a front wall 19' rather than in a sidewall 19. A third conveyor 106 transports the collected materials expelled from the exit/outlet port 70 in the front wall 19' in the opposite direction of the first conveyor, but also upwards. The third conveyor 106 delivers the collected materials 93 to an inlet chute 128 of the second conveyor 26, which transports the collected materials to the collection tank 30 on the vehicle 100.

Where, FIGS. 6-7 showed embodiments, where the unit 10 is configured as a front-runner, FIG. 8 depicts an embodiment, where the unit 10 is configured as a trailing device. It will be appreciated by a person skilled in the art, that this will be possible by a suitable mount/coupling means, arranged on the front side of the unit, rather than on the rear side as shown in FIGS. 6 and 7.

In FIG. 8 the unit 10 is shown with portions of the housing/cover 18 removed, to show the arrangement of the brush 11, the first conveyor 16. Apart from the arrangement of the coupling means between the unit 10 and the vehicle 100, the unit 10 shown in FIG. 8 is the same as the unit 10 shown in FIGS. 6 and 7. Thus, a first conveyor 16 transports the brushed-up, collected materials 93 in the direction of the exit/outlet port 70, transverse of the direction of movement 50. However, the exit/outlet port 70 is arranged in a front wall 19' rather than in a sidewall 19. A third conveyor 106 transports the collected materials expelled from the exit/outlet port 70 in the front wall 19' in the opposite direction of the first conveyor, but also upwards. The third conveyor 106 delivers the collected materials 93 to an inlet chute 128 of the second conveyor 26, which transports the collected materials 93 to the collection tank 30 on the vehicle 100.

Figure 9:
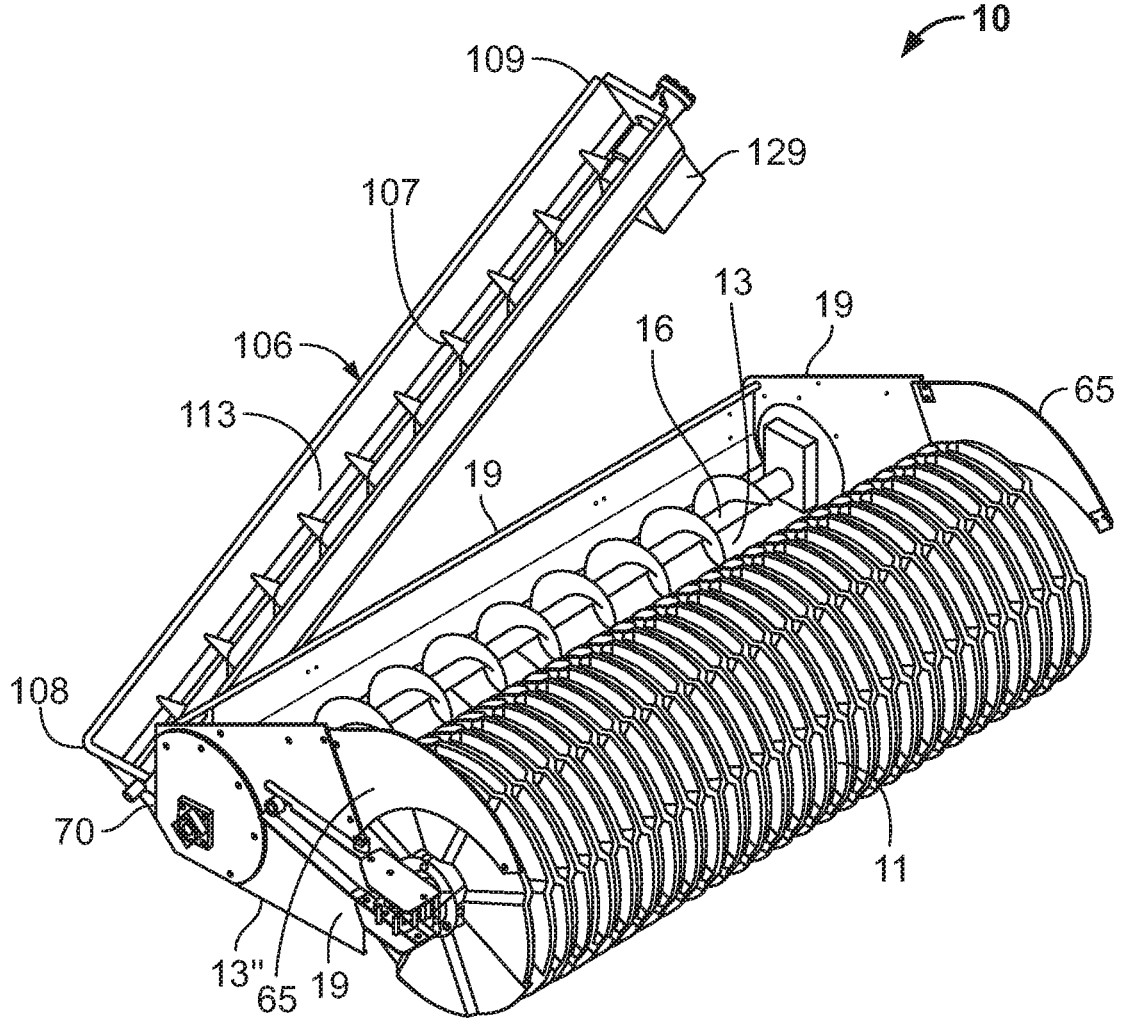
FIG. 9, in a perspective view, shows a deicing liquid recovering unit similar to the deicing liquid recovering unit of FIGS. 6-8 with cover portions detached.
Figure 10:
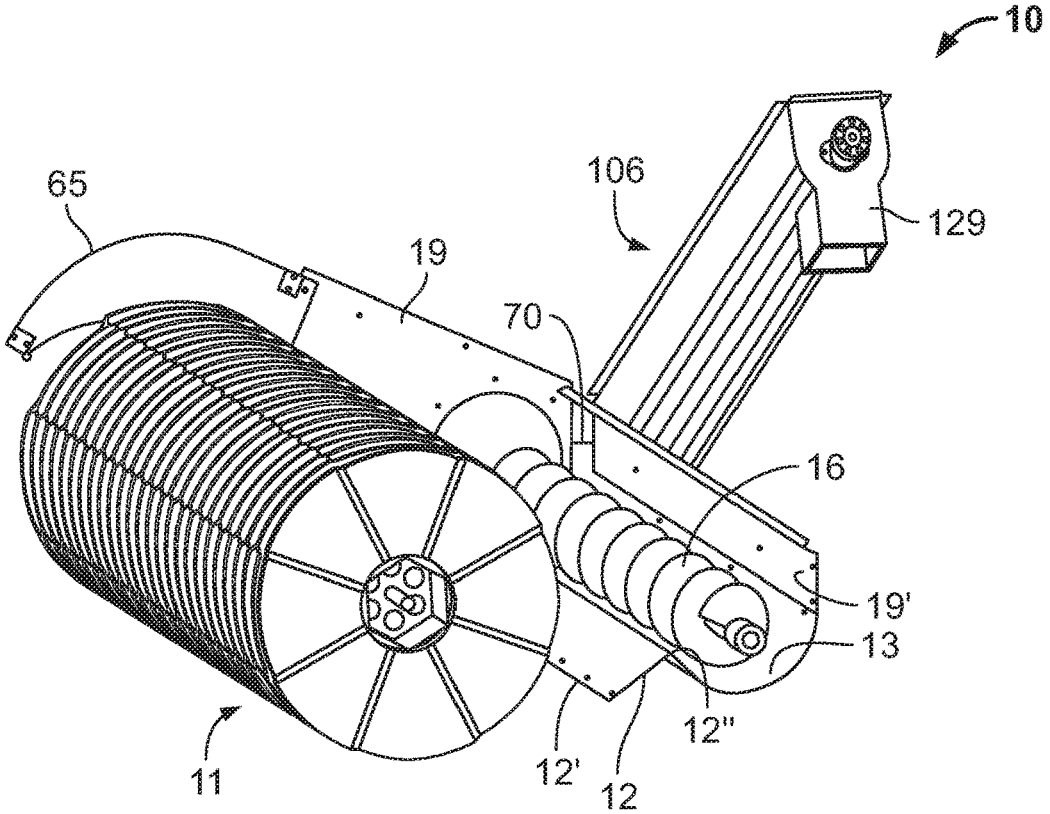
FIG. 10 show the deicing liquid recovering unit of FIG. 9, from a different view, and with further cover portions detached.

FIG. 9, in a perspective view from the rear, shows the deicing liquid recovery unit 10 of the FIGS. 6-7 or FIG. 8 embodiments, but with portions of the housing/cover 18 removed. FIG. 10, also in a perspective view from the rear, but from a different position, shows the deicing liquid recovery unit 10 of FIG. 9 with further portions of the housing/cover 18 and the frame removed, such that the internal parts of the unit 10 are visible. In FIG. 10 it may be appreciated that the arrangement of the baffle 12 is similar to the arrangement described in connection with FIGS. 2 and 3. In particular, in this view, it can be seen that the baffle 12 is arranged between the brush 11 and the first conveyor 16.

Figure 11:
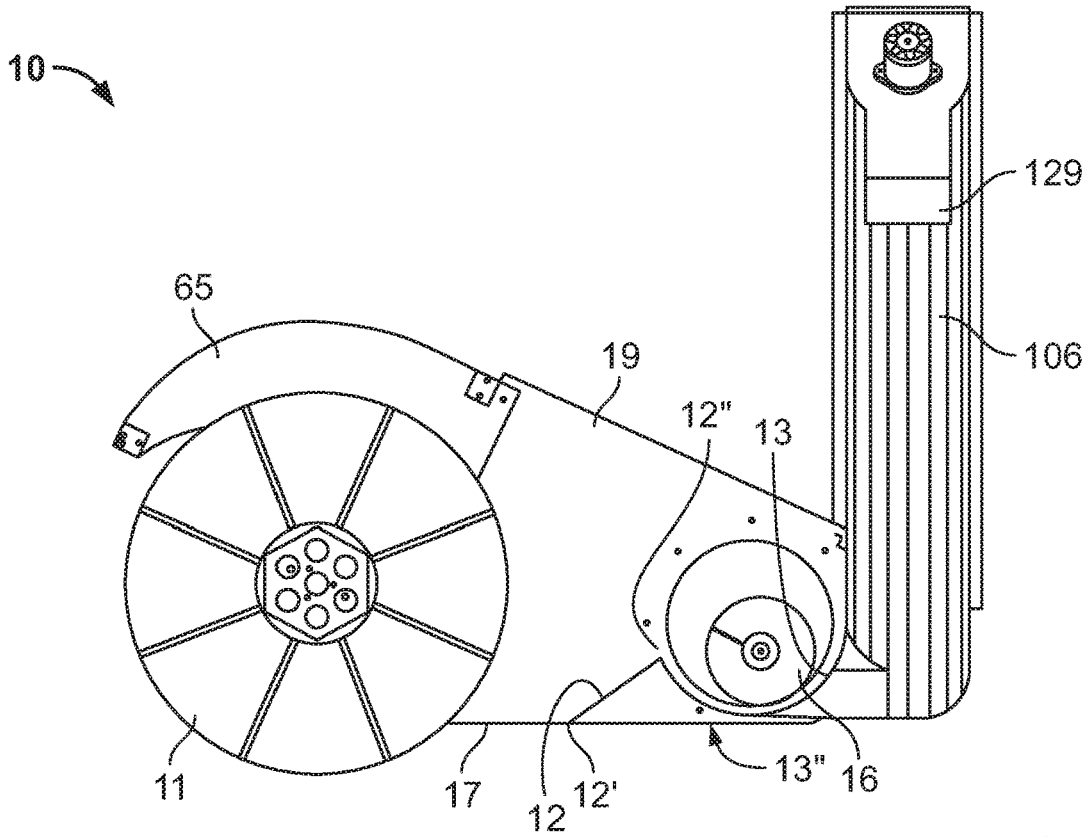
FIG. 11, in a side view, show the deicing liquid recovering unit of FIGS. 9 and 10.

FIG. 11, in a side view, shows the deicing liquid recovery unit 10 of FIG. 10, again with portions of the housing/cover 18 and the frame removed, such that the internal parts of the unit 10 are visible.

The teaching of this invention has numerous advantages. Different embodiments or implementations may yield one or more of the following advantages. It should be noted that this is not an exhaustive list and there may be other advantages, which are not described herein.

Moreover, due to its flexibility and limited space requirement, the system, unit and method according to the invention may be utilized in combination with already existing equipment such as trucks or tractors, which do not already have a deicing liquid recovery system or unit.

In all the previously described embodiments a heating member (not shown) may be applied in the outlet 14 from the collection tray 13 in order to prevent the outlet 14 from freezing/clogging, if the freezing temperature of the collected liquid 94 is higher than the ambient temperature.

Although the teaching of this application has been described in detail for purpose of illustration, it is understood that such detail is solely for that purpose, and variations can be made therein by those skilled in the art without departing from the scope of the teaching of this application.

The term "comprising" as used in the claims does not exclude other elements or steps. The term "a" or "an" as used in the claims does not exclude a plurality. The single processor or other unit may fulfill the functions of several means recited in the claims.

LIST OF REFERENCE NUMBERS

A axis of rotatable horizontal axis cylindrical brush
B axis of auger/first conveyor
1 deicing/anti-icing-liquid recovery system
10 deicing/anti-icing-liquid recovery unit
11 Rotatable brush, rotatable horizontal axis cylindrical brush
12 baffle/pan
12' lower edge of the inclined surface 12''' of the baffle/pan 12
12'' upper edge of the inclined surface 12''' of the baffle/pan 12
12''' inclined surface of the baffle/pan 12
13 collection tray
13' internal bottom of the collection tray
13'' external bottom side of the collection tray
14 liquid outlet from the collection tray
15 Filter
16 first conveyor, expulsion mechanism, e.g. auger/screw conveyor
17 inlet opening in housing
18 housing
18' bottom of housing
19 sidewall of housing 18/collection tray 13
19' front wall of housing 18/collection tray 13
20 pump
21 piping
22 piping
25 connection path from the collection tray to collection tank
26 second conveyor, e.g. auger/screw conveyor
27 flexible portion of connection path from the collection tray to collection tank
28 intermediate connector
29 second or distal end of the second conveyor 26
29' first end 29' of the second conveyor 26
30 first collection tank
31 second collection tank
40 Sensor for glycol concentration measurement
41 control valve for first tank
42 control valve for second tank
50 arrow indicating movement of deicing/anti-icing-liquid recovering unit and/or vehicle during use
51 arrow indicating rotational direction of rotatable brush
52 arrow indicating rotational direction of auger
60 frame of deicing/anti-icing-liquid recovering unit
61 wheel
62 wheel
63 coupling means (for coupling the unit 10 to the vehicle 100)
65 guard or guide plate
70 exit port through housing
71 access doors, exit port through housing
72 access port
90 surface of airport apron/deicing platform at deicing-station or gate
91 surplus deicing/anti icing liquid, ice, water, snow, slush, debris, gravel on surface of airport apron/deicing platform
92 surplus deicing/anti icing liquid, ice, water, snow, slush, debris, gravel from surface of airport apron/deicing platform being brushed over baffle and into collection tray
93 ice, snow, slush, debris, gravel accumulated in collection tray
94 deicing/anti icing liquid, water, debris, gravel in collection tray
95 recovered material including deicing/anti icing liquid in first collection tank
96 recovered liquid deicing/anti icing liquid in second collection tank.
100 vehicle
101 wheel
106 intermediate or third conveyor
107 auger or helical screw of third conveyor
108 first end of third conveyor 106
109 second end of third conveyor 106
113 bottom or housing of third conveyor 106
128 inlet chute of the second conveyor 26
129 outlet of the second conveyor 26
130 adjustable connection means for attaching second conveyor 26 to the unit 10

The invention claimed is:

1. A deicing liquid recovery system for recovering deicing liquid and snow from an airport apron/deicing platform surface, wherein the deicing liquid recovery system comprises:

a deicing-liquid recovery unit moveable in a first direction, wherein the first direction corresponds to a direction of movement when recovering the deicing liquid and snow from the airport apron/deicing platform surface; and a collection tank, wherein said deicing-liquid recovery unit comprises:

a rotatable brush; and a collection tray fluidly connectable to said collection tank and located in front of said rotatable brush in the first direction, wherein no part of the deicing-liquid recovery unit, other than the rotatable brush, engages the airport apron/deicing platform during movement of the deicing-liquid recovery unit in the first direction, wherein the rotatable brush is arranged to sweep the airport apron/deicing platform surface such that material resting on the airport apron/deicing platform surface is forced into the collection tray, said collection tray having an external bottom side, said external bottom side arranged at a distance of 3 to 100 cm from the airport apron/deicing platform surface such that said collection tray passes over said deicing liquid and snow before said rotatable brush sweeps the apron/deicing platform surface when said deicing-liquid recovery unit is moving in said first direction, wherein a first conveyor is arranged in said collection tray and arranged for moving said deicing liquid and snow swept into the collection tray in a direction perpendicular to said first direction and towards an exit port, and wherein said system further comprises a second conveyor for transporting the said deicing liquid and snow from said collection tray to said collection tank.

2. A deicing liquid recovery system according to claim 1, wherein the system further comprises an intermediary conveyor arranged between the exit port from the collection tray and an inlet chute of the second conveyor, and wherein the intermediary conveyor transports said deicing liquid and snow in a direction opposite to said first conveyor.

3. A deicing liquid recovery system according to claim 2, wherein the exit port from the collection tray is arranged through a front wall of the collection tray.

4. A deicing liquid recovery system according to claim 1, wherein said rotatable brush is a horizontal axis cylindrical brush having a horizontal rotational axis.

5. A deicing liquid recovery system according to claim 4, wherein a baffle is located between and the cylindrical brush.

6. A deicing liquid recovery system according to claim 5, wherein an upper edge of the baffle is located at a height above the external bottom side of the collection tray of 5-20 cm.

7. A deicing-liquid recovery unit comprising:

a rotatable brush; and a collection tray fluidly connectable to said collection tank and located in front of said rotatable brush in a first direction, wherein the rotatable brush is arranged to sweep an apron/deicing platform surface such that deicing liquid and snow resting on the apron/deicing platform surface is forced into the collection tray, said collection tray having an external bottom side, said external bottom side arranged at a distance of 3 to 100 cm from the apron/deicing platform surface such that said collection tray passes over said deicing liquid and snow before said rotatable brush sweeps the apron/deicing platform surface when said deicing-liquid recovery unit is moving in the first direction, wherein no part of the deicing-liquid recovery unit, other than the rotatable brush, engages the airport apron/deicing platform during movement of the deicing-liquid recovery unit in the first direction, wherein a first conveyor is arranged in said collection tray and arranged for moving the deicing liquid and snow swept into the collection tray in a direction perpendicular to said first direction and towards an exit port, and wherein said system further comprises a second conveyor for transporting the deicing liquid and snow from said collection tray to said collection tank.

8. A deicing-liquid recovery unit according to claim 7, wherein said deicing-liquid recovery unit further comprises coupling means for attaching the deicing-liquid recovery unit to a vehicle.

9. A method for recovering deicing liquids and snow from an airport apron/deicing platform surface, said method comprising:

moving a deicing-liquid recovery unit over the airport apron/deicing platform surface in a first direction, the deicing-liquid recovery unit comprising a rotatable brush and a collection tray, wherein no part of the deicing-liquid recovery unit, other than the rotatable brush, engages the airport apron/deicing platform during movement of the deicing-liquid recovery unit in the first direction, sweeping deicing liquid and snow from the airport apron/deicing platform surface and into the collection tray by rotating said rotatable brush, said collection tray having an external bottom side, said external bottom side arranged at a distance of 3 to 100 cm from the airport apron/deicing platform surface such that said collection tray passes over the deicing liquid and snow before said rotatable brush sweeps the deicing liquid and snow from the apron/deicing platform surface and into the collection tray when said deicing-liquid recovery unit is moving in said first direction, moving the deicing liquid and snow swept into the collection tray in a second direction perpendicular to said first direction towards an exit port for removal of the deicing liquid and snow, and transporting the deicing liquid and snow from said exit port to a collection tank.

10. A method according to claim 9, further comprising expelling the deicing liquid and snow through an exit port in the first direction, and then moving the expelled deicing liquid and snow in a third direction opposite to said second direction, before transporting said deicing liquid and snow to said collection tank.

11. A method according to claim 9, wherein a baffle is located between the collection tray and the rotatable brush, such that the sweeping of the deicing liquid and snow is made over the baffle and down into the collection tray.

* * * * *